United States Patent [19]

Lee

[11] Patent Number: 4,787,459

[45] Date of Patent: Nov. 29, 1988

[54] RELEASE TECHNIQUE AND DEVICE

[75] Inventor: John Thomas M. Lee, Phoenixville, Pa.

[73] Assignee: ICI Americas Inc., Wilmington, Del.

[21] Appl. No.: 410,337

[22] Filed: Aug. 23, 1982

Related U.S. Application Data

[63] Continuation-in-part of Ser. No. 354,223, Mar. 3, 1982, Pat. No. 4,466,489.

[51] Int. Cl.[4] ..... A62C 37/30

[52] U.S. Cl. ..... 169/42; 169/37; 137/68.1

[58] Field of Search ..... 137/68 A, 68 R; 169/26, 169/28, 37–42; 222/5

[56] References Cited

U.S. PATENT DOCUMENTS

| | | | |
|---|---|---|---|
| 696,884 | 4/1902 | Esty | 169/39 |
| 1,177,339 | 3/1916 | Kleidmann | 169/39 |
| 1,626,863 | 5/1927 | Nacey | 169/39 |
| 3,061,016 | 10/1962 | Hodgman, Jr. | 169/42 |
| 3,567,245 | 3/1971 | Ekstrom | 137/68 A |
| 3,568,448 | 3/1971 | Webb, Jr. | 137/68 A |
| 3,587,601 | 6/1971 | Shippy | 137/68 A |
| 3,726,344 | 4/1973 | Rothman et al. | 169/37 |
| 3,774,807 | 11/1973 | Keathley et al. | 222/5 |
| 3,777,772 | 12/1973 | Arnold et al. | 137/68 A |
| 3,795,413 | 3/1974 | Usui et al. | 137/68 A |
| 3,897,799 | 8/1975 | Lee | 137/70 |
| 4,103,272 | 7/1978 | Larsen | 169/42 |
| 4,208,116 | 6/1980 | Morse | 354/275 |
| 4,241,747 | 12/1980 | King, Sr. | 137/68 R |

OTHER PUBLICATIONS

Frangible Link—Installation-Replacement.

*Primary Examiner*—Sherman D. Basinger
*Assistant Examiner*—Paul E. Salmon

[57] ABSTRACT

Disclosed are a quick release device and a release technique. The device comprises a pair of members or sections which are releasably joined together. These members have opposed surfaces, which in turn have aligned indentations or grooves that form an opening for a radially expandable actuator. Pressurization of the actuator, preferably by an explosive charge therein, forces the two members apart and breaks the joint, allowing the members to separate. The device can take various forms, for example, a valve or a link.

6 Claims, 1 Drawing Sheet

RELEASE TECHNIQUE AND DEVICE

CROSS REFERENCE TO RELATED APPLICATION

This application is a continuation-in-part of applicant's earlier copending application Ser. No. 354,223, filed Mar. 3, 1982 now U.S. Pat. No. 4,466,489, issued Aug. 21, 1984.

BACKGROUND OF THE INVENTION

1. Field of the Invention

This invention relates to a release technique and to devices which may be quickly released by this technique.

2. Description of the Prior Art

Various quick release devices are known in the art. Among these are devices in which mechanical release or separation is accomplished by means of an explosive charge. Such devices and references showing the same include, for example, explosive both (Menichelli U.S. Pat. No. 3,374,702), cable and line cutters (Brizzolara U.S. Pat. Nos. 3,452,631 and 3,482,484) piston actuators (McGirr U.S. Pat. No. 3,354,634), and explosively actuated valves. Other prior art devices are actuated by means of a high explosive in the form of a detonating card or a sheet explosive.

Other prior art explosively actuated devices include the following:

ICI United States Inc. data sheet entitled "Frangible Link—Installation—Replacement" shows a frangible link which is weakened at its mid-portion by notches, and an electrically initiated radially expandable explosive actuator which ruptures the link on command.

Applicant's U.S. Pat. No. 3,897,799 shows a quick opening sleeve valve in which frangible sealing rings formed by brazing or welding secure a slidable sleeve to a stationary shell. Ignition of a squib causes the sleeve to slide and breaks the sealing rings, opening the valve.

U.S. Pat. No. 3,774,807 to Keathley and Lee (the applicant herein) shows an explosively actuated piston valve. In FIGS. 4 and 5, a slidable valve element is secured to a casing member by solder prior to actuation.

U.S. Pat. No. 4,106,875 to Jewett shows an explosively actuated tongue and groove joint which includes an explosive cord between the tongue end wall and the base of the groove, and extending the full length of the joint. The joint is held together by bolts. Firing of the explosive cord causes the forward end of the tongue to collapse, opening the bolt holes. The force of the explosion also drives the two halves of the joint apart.

U.S. Pat. No. 3,660,794 to Brizzolara shows a link comprising two link members that are held together by a fusible ring which is melted on command by burning of a combustible composition.

Devices having releasable joints that are broken by means other than explosives are also known in the art. For example, an automatic sprinkler which is normally held closed by an arrangement that includes a fusible link is shown in Fire Protection Handbook 15th edition, 1981, pages 17-32 to 17-35 and especially FIG. 17-36 on page 17-33 thereof. When a predetermined temperature is reached, the solder joining the link parts together melts, permitting the link parts to separate and allowing the automatic sprinkler to open.

SUMMARY OF THE INVENTION

This invention provides sectional quick release devices which separate on command. A device of this invention comprises a pair of members or sections having opposed surfaces in proximity with each other. The members are releasably joined together by means forming a joint that is weaker than the members themselves, so that the device when actuated will separate along the opposed surfaces. The opposed surfaces have indentations which together form an opening for a radially expandable actuator which, when expanded, forces the members apart and thereby causes the device to separate.

The preferred radially expandable actuator, or radial actuator, contains an explosive charge which can be fired electrically on command. This explosive charge, when detonated, causes the actuator to expand radially, resulting in separation of the device.

This invention in another aspect provides a novel release technique. This technique or method comprises providing a device having a pair of sections releasably joined together and having opposed surfaces having aligned indentations forming an opening for a radially expandable actuator, inserting a radially expandable actuator into said opening, and causing a rapid rise inside the casing of the actuator, thereby causing the casing to expand radially and force the sections apart.

BRIEF DESCRIPTION OF THE DRAWINGS

This invention will now be described in detail with reference to specific embodiments thereof, as illustrated in the accompanying drawings.

In the drawings.

DESCRIPTION OF THE PREFERRED EMBODIMENTS

First Embodiment: Quick Release Valve

Figures 1, 2, 2A, 3, 4, 5, 6, 7, 8, 9:
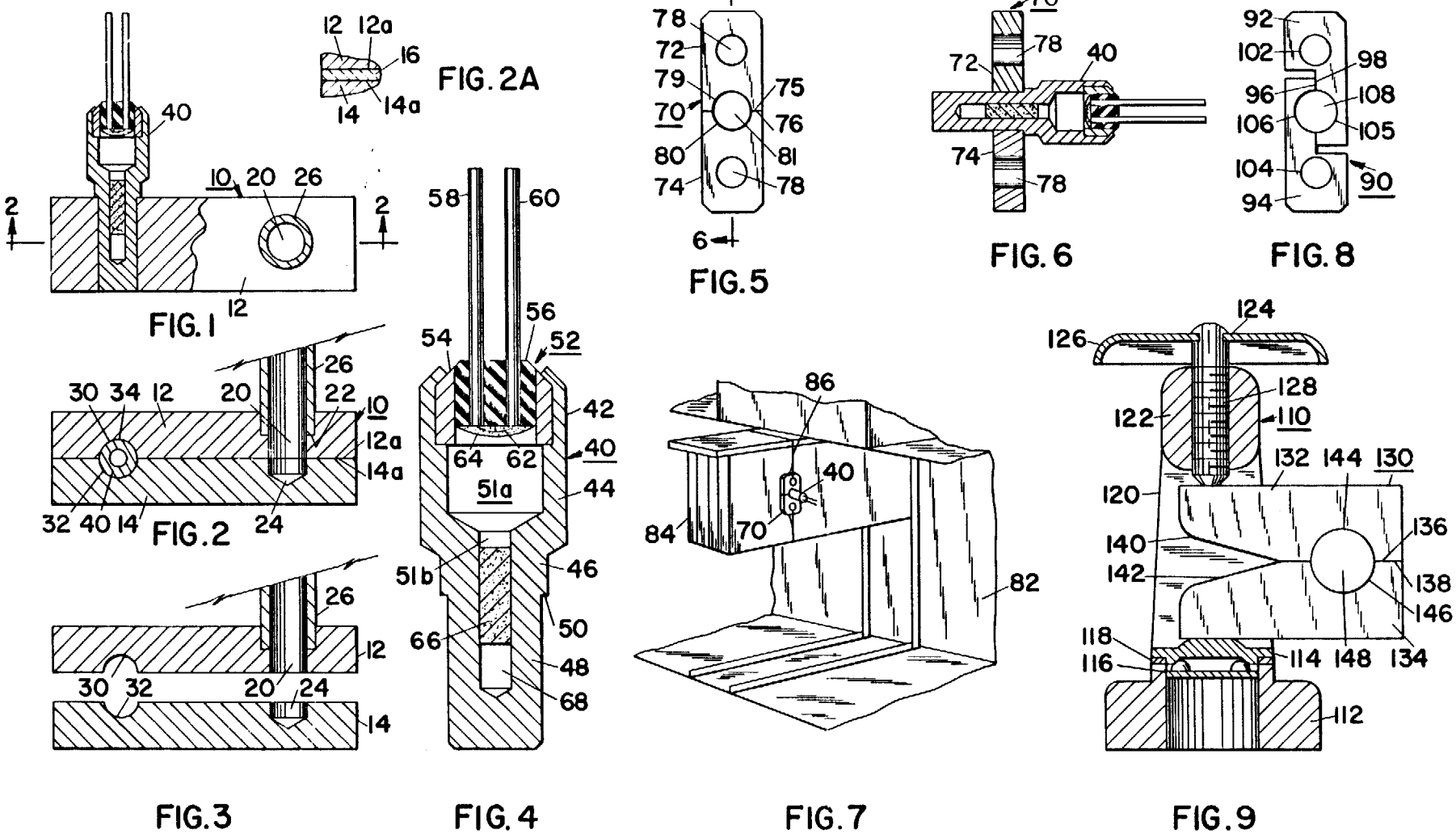
FIG. 1 is a plan view, with portions broken away and shown in section, of the preferred quick release valve according to one embodiment of this invention.
FIG. 2 is a cross-sectional view, taken along line 2—2 of FIG. 1, of the quick release valve before actuation.
FIG. 2A is a fragmentary view showing a portion of the cross section of FIG. 2 on an enlarged scale.
FIG. 3 is a cross-sectional view of the quick release valve after actuation.
FIG. 4 is a cross-sectional view of a radial actuator which is useful in connection with all embodiments of this invention.
FIG. 5 is a front elevational view of a quick release link in accordance with the second embodiment of this invention.
FIG. 6 is a cross-sectional view, taken along line 6—6 of FIG. 5 of the quick release link with an actuator in place.
FIG. 7 is a perspective view of a duct which includes a damper held open by a quick release link of this invention.
FIG. 8 is a front elevational view of an alternative form of quick release link, according to the third embodiment of this invention.
FIG. 9 is a front elevational view, shown partly in section, of an automatic sprinkler valve according to a fourth embodiment of this invention.

The first embodiment of this invention is a normally closed quick release valve which is opened only in case of emergency. This valve maintains a conduit closed so that there is no flow of fluid through that conduit under normal circumstances. The valve is actuated in an emergency, permitting fluid to flow through the conduit. The fluid may be either a liquid or a gas. The valve consists of two separable sections which are separated according to the release technique of this invention when the valve is actuated.

The preferred quick release valve 10 will now be described in further detail with reference to FIGS. 1, 2, 2A and 3. The preferred valve 10 is a one-shot valve. FIGS. 1 and 2 show this valve prior to actuation.

Referring now to FIGS. 1, 2 and 2A, valve 10 comprises a pair of members, here shown as rectangular blocks or plates 12, 14, preferably of a metal such as stainless steel, copper, or brass. Blocks 12 and 14 have opposed mating surfaces 12*a* and 14*a*, respectively, which are preferably planar. Members 12 and 14 are joined together by a thin layer 16 of solder, brazing material, or other bonding material (shown in FIG. 2A) which is applied to surfaces 12*a* and 14*a*. This material forms a fusion bond. The illustration in FIGS. 1 and 2 is larger than actual size; typically the thickness of valve 10 (the combined thickness of blocks 12 and 14 and bonding material 16) is on the order of about ¾ inch (approximately 1.9 cm). The bonding layer 16 is generally very thin, typically about 0.001 inch (about 0.025 mm).

One of the blocks, here shown as block 12, has a port 20 extending in the thickness direction from the outside surface to the central surface to which bonding material 16 is applied. This port 20 may have adjacent portions of different diameters which form a shoulder 22 therebetween. Block 14 may have a recess 24 aligned with port 20. Port 20 is the inlet port for valve 10.

Port 20 receives the end of tubular conduit 26 and forms a closure member therefor. The end of conduit 26 abuts shoulder 22. Valve 10 prior to actuation is in one piece as shown in FIGS. 1 and 2, maintaining conduit 26 closed. Conduit 26 extends from a source (not shown) of fluid under pressure to port 20.

Bonding material 16 forms a hermetic seal which prevents escape of fluid from port 20 to the outside of valve 10.

Opposed surfaces 12*a* and 14*a* have aligned indentations 30 and 32, respectively, which together form an opening 34 for insertion of a radially expandable actuator (hereinafter called a radial actuator) 40. Actuator 40 is adapted to be inserted into opening 34 in close fitting engagement with the walls 30, 32 thereof. Actuator 40, when expanded, breaks the bonding layer 16 and forces members 12 and 14 apart thereby causing the device 10 to be ruptured. Radial actuator 40 will be described in detail with reference to FIG. 4. Indentations or grooves 30 and 32 are semicircular and of uniform radius, and extend from one external surface of valve 10 to the opposite external surface, so that the resulting opening is in the shape of a right circular cylinder which is open at both ends to the exteriors of valve 10. (The opening formed by indentations 30 and 32 may be open to the exterior of valve 10 at only one end if desired).

The bonding layer 16 should have a tensile strength lower than that of the material forming blocks 12 and 14. On the other hand, the tensile strength of the bonding material must be enough to hold blocks 12 and 14 together until actuator 40 is actuated, and to withstand the pressure differential between the fluid pressure communicated through port 20 and the lower pressure surrounding the valve 10. The pressure in conduit and port 20 is usually higher than the pressure surrounding valve 10, so that fluid flow will occur when valve 10 is opened. Conventional tin/lead solders or metallic brazing materials meet these tensile strength requirements in addition to providing the required adhesion. Use of a bonding material which is less strong than the material of blocks 12 and 14 results in a clean separation of these blocks, which remain intact after actuation. Also, the force required for separation is both smaller and more readily predictable than would be the case if bond 16 were stronger than blocks 12 and 14.

Referring now to FIG. 4, radial actuator 40 is a state-of-the-art actuator comprising a metal casing 42 which has a main body portion 44 of one diameter, an intermediate portion 46 of smaller diameter, an expandable forward portion 48 of still smaller diameter, and a shoulder 50 between portions 46 and 48. The casing 42 encloses an interior space comprising two essentially cylindrical chambers, a main chamber 51*a* and a forward chamber 51*b*, the latter being of much smaller diameter than the former. The chambers are in full communication with each other. The normal diameter of the forward portion 48 is just enough smaller than the diameter of opening 34 to permit ready insertion of the actuator 40. The expanded diamter of forward portion 48 must exceed the diameter of opening 34. The diameter of the intermediate portion 46 is larger than that of opening 34. The casing 42, and particularly the expandable forward portion 48 thereof, should be made of a ductile material, such as a relatively ductile stainless steel, which can deform radially without rupturing or leaking.

The casing 42 is closed at the forward end and open at the back end. The back end is closed by a squib 52 which comprises a metal sleeve 54, a glass insulator 56 which forms a fluid-tight glass-to-metal seal with the sleeve 54, a pair of spaced lead wires or pins 58, 60, which extend through the insulator 56, a bridge element (e.g., a bridge wire) 62 connecting the ends of lead wires 58, 60, and an ignition composition 64 in proximity with the bridge element 62. The back end of casing 42 is crimped over sleeve 54, forming a fluid-tight seal.

Inside the metal casing 42, in the forward chamber 51*b*, is an explosive charge 66, typically lead azide. A cylindrical metal piece 68, typically aluminum, spaces the explosive charge 66 from the forward end of the chamber which contains this charge. This prevents rupture of the forward portion 48 of casing 42 when the explosive charge 66 is detonated.

Radial actuator 40 is inserted into opening 34 of valve 10, as shown in FIG. 1, until shoulder 50 is in contact with valve 10. The actuator 40, once inserted into opening 34, may be held in place by a Tinnerman clip (not shown) or by other desired means.

Valve 10 is actuated by applying an electric current through leads 58, 60 to bridge wire 62. This heats the bridge wire and ignition composition 64. Ignition of this composition causes the explosive charge 66 to detonate, causing a rapid rise in pressure inside casing 42. This in turn causes localized radial expansion of the forward portion 48 of the casing 42 without rupturing the casing. The expanded diameter of the forward portion 48 is only slightly larger (say about 0.01 to about 0.015 inch greater) than the normal diameter of this same portion. However, this radial expansion is enough to overcome the tensile strength and elongation of the solder or brazing material layer 16, forcing blocks 12 and 14 apart as shown in FIG. 3. Radial expansion of the expandable forward portion 48 of casing 42 places the layer 16 under a severe tensile stress, sufficient to cause rupture of said layer. The elongation of the solder or brazing material at rupture is about 1000 to 1500%. (The percentage elongation is obtained by dividing the difference between the expanded diameter and the normal diameter of portion 48 by the original thickness of layer 16, and multiplying the quotient by 100). This is a greater elongation than the material 16 can withstand.

Valve 10 is generally useful wherever opening of a fluid conduit in case of emergency is required. The actuator 40 may be initiated either manually, e.g., by pressing a push button switch which causes current to flow through leads 58, 60, or automatically, e.g., by a sensor which is responsive to a condition such as temperature or pressure. A preferred use of valve 10 is as the control valve in the self-contained fire extinguisher described and claimed in my copending application Ser. No. 354,223 cited supra.

Second Embodiment: Quick Release Link

The second embodiment of this invention is a quick release link. This link may be a link which holds open a fire curtain in a duct such as a heating or air conditioning duct. This link consists of two separable sections which may be separated in case of emergency, permitting the fire curtain to close the duct.

Referring now to FIGS. 5 and 6, quick release link 70 has two separable members or sections 72 and 74. Sections 72 and 74 have opposed planar mating surfaces 75 and 76, respectively, along which they are joined together by a thin layer of bonding material, e.g., solder or brazing material as described with reference to FIGS. 2 and 2A. This bonding material is weaker than the material of sections 72 and 74. The plane of the mating surfaces extends transversely of the link 70, which is essentially a rectangular solid with apertures to be described. Sections 72 and 74 are preferably identical in size and shape. Each section has an opening 78 near the outer end thereof to permit attachment of the link to a chain. Opposed surfaces 75 and 76 have aligned indentations 79 and 80 respectively, which together form a cylindrical opening 81 for receiving a radial actuator 40. The axis of opening 81 lies in the plane of surfaces 75 and 76. Radial actuator 40 is inserted into opening 81 as shown in FIG. 6.

Link 70 is caused to separate into sections 72 and 74 by initiation of actuator 40 in the manner described with reference to FIG. 4. Initiation of the actuator 40 causes the actuator to expand radially as previously explained, forcing sections 72 and 74 apart and breaking the bond that holds these sections together.

FIG. 7 illustrates use of link 70 to hold open a fire curtain in an air or gas duct. Referring to FIG. 7, 82 is a duct having a sectional fire curtain 84 therein. Fire curtain 84 is normally held open by chain 86, of which quick release link 70 of this invention is a part. Initiation of actuator 40, either manually (e.g., by a push button switch) or automatically (e.g., by a temperature responsive device) causes link 70 to separate into sections. This in turn allows fire curtain 84 to close.

The duct 82, fire curtain 84 and chain 86 in FIG. 7 are similar to their counterparts shown in the data sheet entitled "Frangible Link—Installation—Replacement" cited supra. Quick release link 70 of this invention replaces the frangible link shown in the data sheet.

This embodiment of the invention illustrates a device which is under tension while in the standing or ready state, i.e., the state prior to actuation. This tension causes the two sections 70, 72 of the device to pull apart upon actuation.

Third Embodiment: Alternative Form of Quick Release Link

The third embodiment of this invention is an alternative form of quick release link, shown in FIG. 8. Referring to FIG. 8, quick release link 90 is an essentially rectangular solid having two separable L-shaped sections 92 and 94. These sections have opposed longitudinally extending planar mating surfaces 96 and 98 respectively. Section 92 and 94 are joined together via a lap joint which includes a thin layer of brazing material or other bonding material between mating surfaces 96 and 98. Holes 102 and 104, near the outer ends of sections 92 and 94 respectively, are provided for attachment of link 90 to a chain. Aligned semicircular indentations 105 and 106 in members 92 and 94 respectively, form a cylindrical opening 108 for a radial actuator 40. The axis of opening 106 lies in the plane of opposed mating surfaces 96 and 98. Opening 108 extends through link 90 in the thickness direction. A radial actuator 40 may be inserted into opening 108 in the manner shown in FIG. 6.

Link 90 is caused to separate into sections 92 and 94 by initiation of actuator 40. Expansion of actuator 40 forces sections 92 and 94 apart in the transverse direction, rupturing the layer of brazing material therebetween.

The joint between sections 92 and 94 of link 90 is under shear stress, rather than under tension as is the case in link 70 shown in FIGS. 5 and 6. The brazing material holding sections 92 and 94 together must be weaker than the material forming link 90, so that separation of the link 90 into sections 92 and 94 takes place by rupture of the brazing material and not by fracture of either section.

Fourth Embodiment: Sprinkler Valve

The fourth embodiment of this invention is a normally closed sprinkler valve which will open quickly when actuated.

FIG. 9 shows the preferred sprinkler valve of this invention in the closed position. Referring now to FIG. 9, 110 is a sprinkler valve having a normally closed outlet 112 for discharging water or other fluid under pressure in case of emergency. The discharge opening of outlet 112 is closed by a valve cap 114 and a gasket (preferably metal) 116. A washer 118 may be provided if desired. Sprinkler valve 110 also has an upright frame 120 which includes an internally screw threaded guideway 122 at its upper end. Guideway 122 receives a handwheel 124, which comprises a dished circular metal deflector 126 and an axially extending screw 128 integral therewith.

A compression member 130, constructed in accordance with this invention, is disposed between valve cap 114 and the forward end of screw 128, and holds the valve cap 114 in place so that outlet 112 is closed. Compression member 130 comprises upper and lower sections 132 and 134 respectively. These sections have opposed planar mating surfaces 136 and 138 respectively. Sections 132 and 134 are joined together along these mating surfaces by a bonding material, e.g., solder or brazing material, in a manner similar to that described with reference to FIGS. 2 and 2A. This bonding material is weaker than the material forming sections 132 and 134. Sections 132, 134 also have beveled surfaces 140, 142 respectively, which are disposed directly above valve cap 114 and below screw 128.

Surfaces 136 and 138 have aligned indentations 144 and 146, respectively, semicircular in shape, which together form an opening 148 for insertion of a radial actuator 40. Opening 148 is cylindrical, with its axis lying in the plane of opposed mating surfaces 136, 138. Opening 148 extends inwardly from at least one exterior surface of compression member 130 and may extend through compression member 130 from one side to the other.

A radial actuator 40 (not shown in FIG. 9) is placed in opening 148 when sprinkler valve is assembled as shown in FIG. 9. The sprinkler valve 110 is in the position shown in FIG. 9 while in its standing or ready state, i.e., prior to actuation. Handwheel 124 may be turned to place compression member 130 under the desired amount of compression. Initiation of radial actuator 40, either manually or automatically as previously described, causes the actuator to expand radially. This breaks the bond between sections 132 and 134, and forces them apart. This releases the compression force that holds valve cap 114 in place. Water pressure in outlet 112 forces cap 112 upwardly, permitting water to be discharged. Sections 132 and 134 tend to rotate so that mating surfaces 136, 138 are parted and beveled surfaces 140, 142 come together. Provision of these beveled surfaces permits such rotation. Water being discharged from outlet 112 is deflected outwardly by deflector 126.

Release Technique

The release technique employed in each of the abovedescribed embodiments of the invention is essentially the same, and may be characterized as follows:

(1) Provide a sectional quick release device comprising two members or sections having opposed surfaces in proximity with each other, with aligned indentations in the opposed surfaces forming an opening for a radially expandable actuator.

(2) Insert a radially expandable actuator (radial actuator) into the opening for that purpose.

(3) Rapidly increase the pressure inside the actuator. This causes the actuator casing to expand radially, striking the two sections and forcing them apart. This in turn breaks the joint holding the two sections together, rupturing (or releasing) the device.

General

Other variations in the device of this invention, besides those already discussed, can be made.

The uses of the device herein described are merely illustrative. The device can be used for other purposes with structural adaptations where necessary.

The opposed surfaces of the two members or sections are preferably planar mating surfaces as shown. Planar surfaces are easier to machine than surfaces of other shapes. However, curved surfaces may be desired in some instances. The surfaces should not be interlocking, because the two members or sections should be free to separate when the actuator is actuated. The surfaces do not have to be of precisely the same shape, although it is generally preferable that they are.

An explosive radial actuator as shown is preferred to other forms of actuators, because a more rapid pressure rise and a greater maximum pressure can be obtained with an explosive charge than by other means. However, it is possible to use other forms of radially expandable actuators, as for example a hollow actuator connected to a source of fluid pressure (e.g., air or steam) which is normally turned off but which can be turned on on command to expand the actuator casing.

All of the devices illustrated herein are small in size and capable of release by a low power radial actuator. However, release of a device according to this invention may actuate a much larger device or assembly as described herein.

The joint holding the two members or sections together may take forms other than the butt and lap joints illustrated. For example, the members may be spot welded together.

The joint which holds the sections of a device according to this invention may be either under tension as in FIG. 5, under shear as in FIG. 8, or substantially unstressed as in FIG. 1.

The above illustrate modifications which can be made without departing from the present invention. Other modifications can also be made.

A major advantage of the devices of this invention is their simplicity and the absence of moving parts. Release of a device of this invention causes the members to separate rather than to cause two parts to move relative to each other while in frictional engagement.

Another important advantage of the present devices is safety. These devices are safe to handle and use. The radial actuator 40, even if fired while in a person's hand, will not cause serious injury, because the casing expands only slightly and does not rupture. The released members separate at low velocities, and there is no need for secondary safety shields. In addition, the devices are self-contained and virtually noiseless in operation.

Devices of this invention are very fast acting. The time for release from application of the firing signal (i.e., electrical initiation) is approximately 300 microseconds in a typical device.

Another advantage is that low power inputs may be used a typical firing current for the radial actuator shown is one ampere. The ignition system for the actuator can be designed to fire on capacitor discharge with as little as 500 ergs.

Ductile materials can be used for both the structural members and the bonding material. The material for the structural members can be chosen for strength, corrosion resistance, or whatever other properties are needed or desired for the intended use of the device. The advantages of this wide choice of materials can be appreciated by comparing the release link of FIGS. 5 and 6 herein with the frangible link shown in the ICI United States data sheet cited supra. A brittle material (one having a low elongation at the time of fracture) must be used in making the frangible link shown in the data sheet; otherwise the radial actuator might merely elongate rather than fracture the frangible link. (Other prior art notched frangible structures must also be made of brittle materials). The link of FIGS. 5 and 6 may be made of ductile materials which are stronger and more shock resistant than the brittle materials required in prior art frangible structures.

A ductile material having a high elongation at the time of fracture can be used for the bonding material of devices herein. This means that the bonding material may be chosen with a view to other desired properties, such as adherence to the structural members, strength, melting point, etc. Also, use of ductile materials for both the bonding layer and the structural members gives devices having good shock resistance.

In conclusion, applicant has provided a simple, reliable device which is adaptable to virtually any situation where a quick release device is required.

What is claimed is:

1. A quick release valve comprising:

(a) a pair of members opposed surfaces in proximity with each other;

(b) means comprising a thin layer of bonding material between said opposed surfaces for releasably joining said members together, said bonding material being weaker than the material forming said members so that the device when actuated separates along said opposed surfaces;

(c) a port in one of said members extending from an external surface of said member to the surface of said member which is in proximity with the other member, said bonding material forming a hermetic seal which prevents discharge of fluid through said port;

(d) said opposed surfaces having aligned indentations which together form an opening for a radially expandable actuator which, when expanded, forces said members apart and thereby causes said members to separate; and (e) A radially expandable actuator adapted to be inserted into said opening in close fitting engagement with the walls thereof, said actuator having a casing at least a portion of which is radially expandable, and means for generating within said casing on command an internal pressure sufficient to expand said casing radially and thereby force said members apart.

2. A quick release device according to claim 1 in which said opposed surfaces are essentially planar.

3. A quick release device according to claim 2 in which said aligned indentations in said opposed surfaces are essentially semicircular, thereby forming a cylindrical opening of circular cross section.

4. A quick release device according to claim 1 in which said means for generating internal pressure is an explosive charge.

5. A quick release device according to claim 1 in which said radially expandable actuator is an explosive actuator, and in which opposed surfaces are planar and have aligned semicircular indentations therein.

6. A quick release valve according to claim 1 wherein the opposed surfaces in proximity with each other are essentially planar and the opening formed by the aligned indentations is a cylindrical opening of circular cross-section.

* * * * *